US009668065B2

(12) United States Patent
Tiefenau et al.

(10) Patent No.: US 9,668,065 B2
(45) Date of Patent: May 30, 2017

(54) ACOUSTICAL MODULE WITH ACOUSTICAL FILTER

(71) Applicant: Sonion Nederland B.V., Hoofddorp (NL)

(72) Inventors: Andreas Tiefenau, Koog a/d Zaan (NL); Koen van Gilst, Uithoorn (NL); Laurens de Ruijter, Haarlem (NL); Nicolaas Maria Jozef Stoffels, Haarlem (NL); Mike Geskus, Purmerend (NL); Rasmus Voss, The Hague (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 14/858,417

(22) Filed: Sep. 18, 2015

(65) Prior Publication Data

US 2017/0085995 A1 Mar. 23, 2017

(51) Int. Cl.
*H04R 25/00* (2006.01)
*H04R 1/08* (2006.01)

(52) U.S. Cl.
CPC ..... *H04R 25/35* (2013.01); *H04R 1/086* (2013.01); *H04R 25/405* (2013.01); *H04R 2225/025* (2013.01); *H04R 2225/43* (2013.01)

(58) Field of Classification Search
CPC ..... H04R 25/35; H04R 25/405; H04R 1/086; H04R 2225/43; H04R 2225/025
See application file for complete search history.

(56) References Cited

U.S. PATENT DOCUMENTS

| | | | | |
|---|---|---|---|---|
| 5,214,709 | A * | 5/1993 | Ribic | H04R 1/38 367/126 |
| 6,724,902 | B1 | 4/2004 | Shennib | |
| 6,788,796 | B1 | 9/2004 | Miles et al. | |
| 6,831,577 | B1 | 12/2004 | Furst | |
| 6,853,290 | B2 | 2/2005 | Jorgensen et al. | |
| 6,859,542 | B2 | 2/2005 | Johannsen et al. | |
| 6,888,408 | B2 | 5/2005 | Furst et al. | |
| 6,914,992 | B1 | 7/2005 | van Halteren et al. | |
| 6,919,519 | B2 | 7/2005 | Ravnkilde et al. | |
| 6,930,259 | B1 | 8/2005 | Jorgensen et al. | |
| 6,943,308 | B2 | 9/2005 | Ravnkilde et al. | |

(Continued)

FOREIGN PATENT DOCUMENTS

| | | | |
|---|---|---|---|
| EP | 2843971 | A1 | 3/2015 |
| GB | 1383473 | A | 2/1974 |
| WO | WO 01/01732 | A1 | 1/2001 |

OTHER PUBLICATIONS

Partial European Search Report for Application No. EP 15185813, date of completion the search Mar. 10, 2016 (3 pages).

*Primary Examiner* — Tuan D Nguyen
(74) *Attorney, Agent, or Firm* — Nixon Peabody LLP

(57) ABSTRACT

An acoustical module including a receiver unit for generating audio sound, microphone units for receiving acoustical pressure signals, and acoustical pressure pick-up points. Each of the acoustical pressure pick-up points is acoustically connected to a microphone unit. The module further includes an acoustical filter for attenuating acoustical pressure signals from a first acoustical pressure pick-up point relative to a second acoustical pressure pick-up point. The invention further relates to a hearing device comprising an acoustical module.

17 Claims, 7 Drawing Sheets

(56) References Cited

U.S. PATENT DOCUMENTS

| | | | |
|---|---|---|---|
| 6,974,921 | B2 | 12/2005 | Jorgensen et al. |
| 7,008,271 | B2 | 3/2006 | Jorgensen |
| 7,012,200 | B2 | 3/2006 | Moller |
| 7,062,058 | B2 | 6/2006 | Steeman et al. |
| 7,062,063 | B2 | 6/2006 | Hansen et al. |
| 7,072,482 | B2 | 7/2006 | Van Doorn et al. |
| 7,088,839 | B2 | 8/2006 | Geschiere et al. |
| 7,110,560 | B2 | 9/2006 | Stenberg |
| 7,136,496 | B2 | 11/2006 | van Halteren et al. |
| 7,142,682 | B2 | 11/2006 | Mullenborn et al. |
| 7,181,035 | B2 | 2/2007 | van Halteren et al. |
| 7,190,803 | B2 | 3/2007 | van Halteren |
| 7,206,428 | B2 | 4/2007 | Geschiere et al. |
| 7,221,767 | B2 | 5/2007 | Mullenborn et al. |
| 7,221,769 | B1 | 5/2007 | Jorgensen |
| 7,227,968 | B2 | 6/2007 | van Heltren et al. |
| 7,239,714 | B2 | 7/2007 | de Blok et al. |
| 7,245,734 | B2 | 7/2007 | Niederdraenk |
| 7,254,248 | B2 | 8/2007 | Johannsen et al. |
| 7,286,680 | B2 | 10/2007 | Steeman et al. |
| 7,292,700 | B1 | 11/2007 | Engbert et al. |
| 7,292,876 | B2 | 11/2007 | Bosh et al. |
| 7,336,794 | B2 | 2/2008 | Furst et al. |
| 7,376,240 | B2 | 5/2008 | Hansen et al. |
| 7,403,630 | B2 | 7/2008 | Jorgensen et al. |
| 7,415,121 | B2 | 8/2008 | Mögelin et al. |
| 7,425,196 | B2 | 9/2008 | Jorgensen et al. |
| 7,460,681 | B2 | 12/2008 | Geschiere et al. |
| 7,466,835 | B2 | 12/2008 | Stenberg et al. |
| 7,492,919 | B2 | 2/2009 | Engbert et al. |
| 7,548,626 | B2 | 6/2009 | Stenberg et al. |
| 7,657,048 | B2 | 2/2010 | van Halteren et al. |
| 7,684,575 | B2 | 3/2010 | van Halteren et al. |
| 7,706,561 | B2 | 4/2010 | Wilmink et al. |
| 7,715,583 | B2 | 5/2010 | Van Halteren et al. |
| 7,728,237 | B2 | 6/2010 | Pedersen et al. |
| 7,809,151 | B2 | 10/2010 | Van Halteren et al. |
| 7,822,218 | B2 | 10/2010 | Van Halteren |
| 7,899,203 | B2 | 3/2011 | Van Halteren et al. |
| 7,912,240 | B2 | 3/2011 | Madaffari et al. |
| 7,946,890 | B1 | 5/2011 | Bondo et al. |
| 7,953,241 | B2 | 5/2011 | Jorgensen et al. |
| 7,961,899 | B2 | 6/2011 | Van Halteren et al. |
| 7,970,161 | B2 | 6/2011 | van Halteren |
| 8,098,854 | B2 | 1/2012 | van Halteren et al. |
| 8,101,876 | B2 | 1/2012 | Andreasen et al. |
| 8,103,039 | B2 | 1/2012 | van Halteren et al. |
| 8,160,290 | B2 | 4/2012 | Jorgensen et al. |
| 8,170,249 | B2 | 5/2012 | Halteren |
| 8,189,804 | B2 | 5/2012 | Hruza |
| 8,189,820 | B2 | 5/2012 | Wang |
| 8,223,996 | B2 | 7/2012 | Beekman et al. |
| 8,233,652 | B2 | 7/2012 | Jorgensen et al. |
| 8,259,963 | B2 | 9/2012 | Stenberg et al. |
| 8,259,976 | B2 | 9/2012 | van Halteren |
| 8,259,977 | B2 | 9/2012 | Jorgensen et al. |
| 8,280,082 | B2 | 10/2012 | van Halteren et al. |
| 8,284,966 | B2 | 10/2012 | Wilk et al. |
| 8,313,336 | B2 | 11/2012 | Bondo et al. |
| 8,315,422 | B2 | 11/2012 | van Halteren et al. |
| 8,331,595 | B2 | 12/2012 | van Halteren |
| 8,369,552 | B2 | 2/2013 | Engbert et al. |
| 8,379,899 | B2 | 2/2013 | van Halteren et al. |
| 8,509,468 | B2 | 8/2013 | van Halteren et al. |
| 8,526,651 | B2 | 9/2013 | Lafort et al. |
| 8,526,652 | B2 | 9/2013 | Ambrose et al. |
| 2001/0008559 | A1 | 7/2001 | Roo |
| 2007/0053538 | A1* | 3/2007 | Jensen ..... H04R 1/086 381/359 |
| 2011/0182453 | A1 | 7/2011 | van Hal et al. |
| 2011/0189880 | A1 | 8/2011 | Bondo et al. |
| 2011/0299708 | A1 | 12/2011 | Bondo et al. |
| 2011/0299712 | A1 | 12/2011 | Bondo et al. |
| 2011/0311069 | A1 | 12/2011 | Ambrose et al. |
| 2012/0014548 | A1 | 1/2012 | van Halteren |
| 2012/0027245 | A1 | 2/2012 | van Halteren et al. |
| 2012/0140966 | A1 | 6/2012 | Mocking et al. |
| 2012/0155683 | A1 | 6/2012 | van Halteren |
| 2012/0155694 | A1 | 6/2012 | Reeuwijk et al. |
| 2012/0255805 | A1 | 10/2012 | van Halteren et al. |
| 2013/0028451 | A1 | 1/2013 | de Roo |
| 2013/0136284 | A1 | 5/2013 | van Hal et al. |
| 2013/0142370 | A1 | 6/2013 | Engbert et al. |
| 2013/0163799 | A1 | 6/2013 | Van Halteren |
| 2013/0195295 | A1 | 8/2013 | van Halteren et al. |

* cited by examiner

ACOUSTICAL MODULE WITH ACOUSTICAL FILTER

FIELD OF THE INVENTION

The present invention relates to an acoustical module configured to separate sound pressure signals from external sources. In particular, the present invention relates to an acoustical module where the influence of self-generated signals is attenuated.

BACKGROUND OF THE INVENTION

Various arrangements involving two sound detectors have been suggested over the years.

An example is U.S. Pat. No. 8,259,976 where an assembly comprising a sound emitter and at least two sound detectors fixed to each other is disclosed. Each detector has a sound receiving opening. The sound receiving openings of at least two of the detectors point in opposite directions. However, there is in U.S. Pat. No. 8,259,976 no disclosure of a feedback suppression algorithm for reducing the influence of self-generated signals, such as acoustic signals and vibration signals.

It may be seen as an object of embodiments of the present invention to provide an acoustical module where the influence of self-generated signals is attenuated. Such self-generated signals may involve acoustical signals and vibration signals.

SUMMARY OF INVENTION

The above-mentioned object is complied with by providing, in a first aspect, an acoustical module comprising a receiver unit for generating audio sound, a plurality of microphone units for receiving acoustical pressure signals, a plurality of acoustical pressure pick-up points, each of said acoustical pressure pick-up points being acoustically connected to a microphone unit, and an acoustical filter for attenuating an acoustical pressure signal arriving at a first acoustical pressure pick-up point relative to a second acoustical pressure pick-up point.

The acoustical module of the present invention is thus adapted to receive incoming acoustical pressure signals via a plurality of microphone units and regenerate the received signal via the receiver unit. The acoustical module of the present invention may be applicable in relation to hearing devices, such as various types of hearing aids.

In the present content pressure pick-up points are to be understood as openings and/or holes through which incoming acoustical pressure signals are allowed to enter the acoustical module. In order to convert the incoming acoustical pressure signals to electrical signals at least one microphone unit may be acoustically connected to each of the pressure pick-up points.

In the present content acoustical pressure signals are to be understood as acoustical sound/audio signals representing for example speech, music etc.

The receiver unit may comprise a single receiver or a plurality of receivers. In case of a single receiver a single acoustical signal and a signal vibration signal is generated. A plurality of receivers may collectively generate both acoustical signals and vibration signals. The contribution of all receivers may be combined into a total acoustic signal and a total vibration signal.

The acoustical filter may advantageously be positioned between the first and the second acoustical pressure pick-up points. In this manner an incoming acoustical signal may be attenuated upon passing the acoustical filter so that the acoustical pressure pick-up points receive an incoming acoustical signal with different strengths.

In view of the remarks set forth above a first microphone unit may be acoustically connected to the first acoustical pressure pick-up point, and a second microphone unit may be acoustically connected to the second acoustical pressure pick-up point.

The acoustical filter may form a dome shaped structure or at least a part of a dome shaped structure. Alternatively, it may be attached to a dome shaped structure. Dome shaped structures may exhibit additional properties in relation to the acoustical module. Such additional properties may include proper fixation of the acoustical module in an ear channel. Along this line the acoustical filter may form part of, or being attached to, an element which is adapted to support fixation of the acoustical module in an ear channel.

The acoustical module may further comprise one or more additional domes or elements for additional support of the fixation of the acoustical module in the ear channel.

The acoustical module may further comprise an additional acoustical filter and a third acoustical pressure pick-up point being acoustically connected to a microphone unit. In this embodiment the additional acoustical filter may either be positioned between the second and the third acoustical pressure pick-up points or between the first and second pressure pick-up points. Additionally, acoustical filters can be placed between all off the pressure pick-up points. By applying more than two acoustical pressure pick-up points the suppression of the unwanted signals can be further improved. In addition, the reconstruction of the head-related transfer function (HRTF) could be at least partly achieved which is otherwise lost due to the fact that the microphone units are not at the exact position of the ear drum. Finally, additional acoustical pressure pick-up points may also be used to generate another desired directionality of the acoustical module. The additional acoustical filter may form part of a dome shaped structure or it may be attached to a dome shaped structure being shaped in a manner so that it supports fixation of the acoustical module in an ear channel.

The plurality of microphone units may comprise omni directional microphone units and/or directional microphone units.

A sleeve may be provided to ease fixation of a dome to the exterior of the acoustical module. As already stated the dome may either comprise or have an acoustical filter attached thereto. The sleeve may be manufactured using an injection mouldable material, such as a polymer material. Preferably, the sleeve and the dome form a one-piece component.

The acoustical module may further comprise a protection arrangement for preventing dust or other impurities to enter the plurality of acoustical pressure pick-up points. The protection arrangement may comprise a number of barrier structures being either secured to or forming part of the sleeve.

In a second aspect the present invention relates to a hearing device comprising an acoustical module according to the first aspect. The hearing device may comprise a hearing aid of any type, including in-the-channel (ITC) type hearing aids.

BRIEF DESCRIPTION OF THE DRAWINGS

The present invention will now be described in further details with reference to the accompanying figures, wherein.

Figure 1:
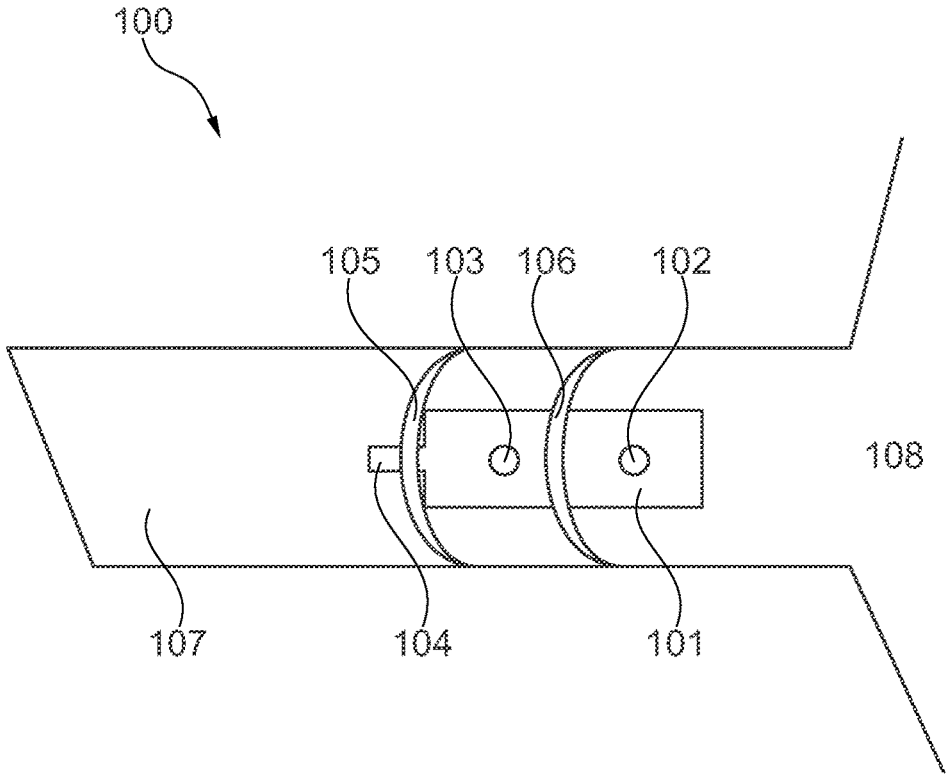
FIG. 1 shows a first embodiment of an acoustical module having two acoustical pressure pick-up points and an acoustical filter realized by means of a dome positioned therebetween.

While the invention is susceptible to various modifications and alternative forms specific embodiments have been shown by way of examples in the drawings and will be described in details herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

In its most general aspect the present invention relates to an acoustical module being capable of suppressing self-generated acoustical signal and self-generated vibrations. In its most simple implementation the acoustical module comprises a sound generating receiver and two acoustical pressure pick-up points where acoustical sound is allowed to enter the module. One or more acoustical filters are provided between the acoustical pressure pick-up points.

Each of the two acoustical pressure pick-up points picks up the following signals:

1) external sound, i.e. the signal to be detected
2) self-generated acoustical sound
3) self-generated vibration signal The acoustical module of the present invention is adapted to be positioned inside the ear channel. In this position the two acoustical pressure pick-up points form an outer pick-up point, A, and an inner pick-up point, B.

As stated above each of the two acoustical pressure pick-up points will pick up a self-generated acoustical receiver signal, $S_{Rec,acc}$, a self-generated vibration receiver signal, $S_{Rec,vib}$, and the external acoustical sound, $S_{Ext}$. This may be expressed as follows:

$$S_{MicA}=S_{Rec,acc}{}^{A}+S_{Rec,vib}{}^{A}+S_{Ext}{}^{A} \tag{1}$$

$$S_{MicB}=S_{Rec.acc}{}^{B}+S_{Rec.vib}{}^{B}+S_{Ext}{}^{B} \tag{2}$$

where $S_{MicA}$ and $S_{MicB}$ are microphone signals being acoustically connected to the acoustical pressure pick-up points A and B, respectively.

Since the two contributions of the receiver ($S_{Rec,acc}$ and $S^{Rec,vib}$) are generated by the same source they are highly correlated, and may therefore be combined into one source (eq. (3) and (4))

$$S_{Rec}{}^{A}=S_{Rec,acc}{}^{A}+S_{Rec,vib}{}^{A} \tag{3}$$

$$S_{Rec}{}^{B}=S_{Rec,acc}{}^{B}+S_{Rec,vib}{}^{B} \tag{4}$$

which when substituted into eq. (1) and (2) yields $$S_{MicA}=S_{Rec}{}^{A}+S_{Ext}{}^{A} \tag{5}$$

$$S_{MicB}=S_{Rec}{}^{B}+S_{Ext}{}^{B} \tag{6}$$

The ratio between the total contributions from the receivers $$\delta_{Rec}^{A-B}=\frac{S_{Rec}^{A}}{S_{Rec}^{B}} \tag{7}$$

can be assumed as being frequency dependent, but constant over time. Moreover, the influence of the external acoustic scenery is minimized by the fact, that the acoustical module is placed inside the ear channel.

By knowing the ratio $\delta_{Rec}{}^{A-B}$ for the acoustical module in a given wearing position, an artificial microphone signal can be calculated from two acoustical pressure pick-up points, which does not contain a self-generated component originating from the receiver.

$$S_{Mic}{}^{art}=S_{A}-\delta_{Rec}{}^{A-B}\cdot S_{B} \tag{8}$$

By applying eq. (5), this can be rewritten as:

$$S_{Mic}{}^{art}=S_{Ext}{}^{A}-\delta_{Rec}{}^{A-B}S_{Ext}{}^{B} \tag{9}$$

Similarly, by knowing the ratio $$\delta_{ext}^{B-A}=\frac{S_{Ext}^{B}}{S_{Ext}^{A}}$$

in which external sound is picked up by the module in a given wearing position, the sensitivity of the artificial microphone signal $S_{Mic}{}^{art}$ can be compared to the external sound sources of a single microphone.

$$S_{Mic}{}^{art}=S_{Ext}{}^{A}(1-\delta_{Rec}{}^{A-B}\delta_{Ext}{}^{B-A}) \tag{10}$$

Since the noise of the microphones can be assumed as being non-correlated, the total noise of the artificial microphone can be assumed as:

$$N_{Mic}{}^{art}=\sqrt{(N_{\mathrm{MicA}})^2+(\delta_{Rec}{}^{A-B}\cdot N_{\mathrm{MicB}})^2} \tag{11}$$

Under the assumption that two identical microphones are used in relation to acoustical pressure pick-up points A and B, the total noise can be assumed as:

$$N_{Mic}{}^{art}=N_{Mic}\sqrt{1+(\delta_{Rec}{}^{A-B})^2} \tag{12}$$

The signal-to-noise ratio (SNR) of a single microphone being acoustically connected to pressure pick-up point A, without considering the acoustical and vibration feedback signals of the receiver, would be:

$$SNR_{Mic}^{A} = \frac{S_{Ext}^{A}}{N_{Mic}} \tag{13}$$

The SNR of the artificial microphone would be:

$$SNR_{Mic}^{art} = \frac{S_{Ext}^{A}}{N_{Mic}} \cdot \frac{(1 - \delta_{Rec}^{A-B}\delta_{Ext}^{B-A})}{\sqrt{1 + (\delta_{Rec}^{A-B})^2}} \tag{14}$$

The SNR of the acoustical module can be optimized by adding a filtering element, which reduces the external sound signal in pressure pick-up point B relative to pressure pick-up point A, whereby minimizing the term $\delta_{Ext}^{B-A}$ as well as the SNR of the artificial microphone.

Moreover, by applying more than two acoustical pressure pick-up points the robustness of the suppression of the receiver signals ($S_{Rec,acc}$ and $S_{Rec,vib}$) can be further improved. In addition, the reconstruction of the HRTF could be at least partly achieved, which is partially lost due to the fact that the microphones are not at the exact position of the ear drum. Additional acoustical pressure pick-up points could also be used to generate another desired directionality of the acoustical module.

As stated above the SNR of the acoustical module can be improved by adding a damping and/or a filtering element between the acoustical pressure pick-up points A and B in order to reduce the external sound signal in pressure pick-up point B relative to pressure pick-up point A.

A suitable filtering element may be implemented as a dome as already used in today's receiver-in-channel (RIC) hearing aids to hold the receiver in place. Alternatively, any other acoustic sealing/filtering element or another support element to hold the acoustic module in a certain position relative to the ear canal may be applied as a filter. This type of dome may be seen as a passive acoustic element. The dome provides an acoustic resistance, a mass and a compliance which is mainly defined by the leakage around the dome and through-going openings/holes in the dome. The openings/holes can be designed in such a way, that a wanted combined resistance/mass/compliance is achieved. The created effective acoustic filter is defined by these values and the surrounding acoustic environment.

By adding an acoustic filtering element, such as a dome, between two acoustical pick-up points a beneficial change in signal attenuation between the two pick-up points can be achieved. Moreover, the influence of self-generated acoustic and vibration feedback signals can be suppressed by proper signal processing.

In the following various embodiments of the present invention will be disclosed.

Referring now to FIG. 1 an embodiment 100 of the present invention is depicted. As seen the acoustical module 101 comprises two acoustical pressure pick-up points 102, 103 for receiving incoming sound from the outer ear 108. The acoustical module is positioned in the ear channel 107 with a sound generating receiver 104 facing the eardrum (not shown). A pair or dome shaped acoustical filters 105, 106 improve the wearing comfort of the acoustical module while being positioned in the ear channel 107. The dome 106 forms an acoustical filter between acoustical pressure pick-up point 102 and 103 so that acoustical sound arriving from the outer ear 108 is attenuated before arriving at pressure pick-up point 103. Thus, the acoustical sound signal reaching pressure pick-up point 103 is attenuated relative to the acoustical sound pressure reaching pressure pick-up point 102. By applying the above-mentioned signal processing algorithm the influence of self-generated acoustical signals as well as self-generated vibration signals can be attenuated.

The acoustical module depicted further comprises an arrangement of microphone units (not shown) being acoustically connected to the acoustical pressure pick-up points 102, 103. The microphone units applied may be omni directional and/or directional microphones in suitable combinations. Also, microphone modules comprising for example two microphone units and a common back volume are applicable as well.

Several advantages are associated with the arrangement depicted in FIG. 1. Firstly, the wearing comfort and/or the retention force of the acoustical module are both improved. The reason for this being that two domes leads to an increase of the surface touching the ear channel. This increased surface area can either be used to reduce the local contact pressure while keeping the retention force at the same level as with a single dome, or to increase the retention force without increasing the contact pressure. Secondly, the stable positioning of the acoustical pressure pick-up points relative to the ear channel prevents blockage of the pick-up points.

Figure 2:
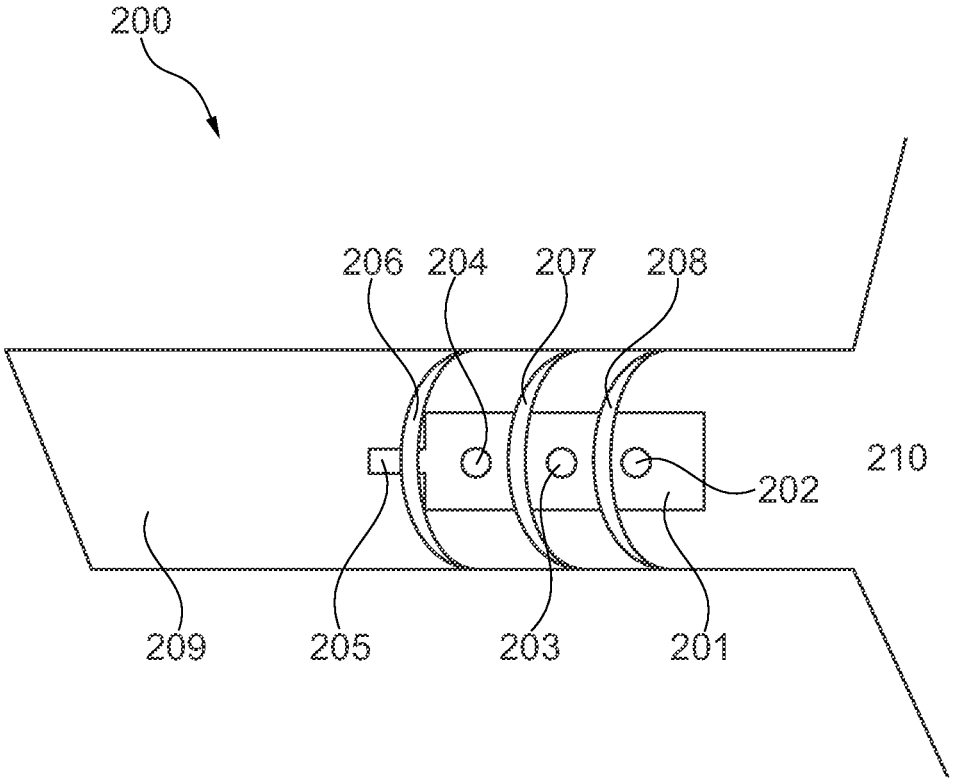
FIG. 2 shows an acoustical module having three acoustical pressure pick-up points and two acoustical filters by means of domes positioned therebetween.

Referring now to FIG. 2 another embodiment 200 of the present invention is depicted. As seen the acoustical module 201 comprises three acoustical pressure pick-up points 202, 203, 204 for receiving incoming sound from the outer ear 210. The acoustical module is positioned in the ear channel 209 with a sound generating receiver 205 facing the eardrum (not shown). Three dome shaped acoustical filters 206, 207, 208 improve the wearing comfort of the acoustical module while being positioned in the ear channel 209. The domes 207, 208 form acoustical filters between acoustical pressure pick-up point 203, 204 and 202, 203, respectively. This ensures that acoustical sound arriving from the outer ear 210 is attenuated before arriving at pressure pick-up points 203 and 204. By applying the above-mentioned signal processing algorithm the influence of self-generated acoustical signals as well as self-generated vibration signals can be attenuated. Moreover, by applying a third acoustical pressure pick-up point the robustness of the suppression of the receiver signals ($S_{Rec,acc}$ and $S_{Rec,vib}$) can be further improved, cf. the above algorithm. In addition, the reconstruction of the HRTF could be at least partly achieved.

Similar to FIG. 1 the acoustical module depicted in FIG. 2 further comprises an arrangement of microphone units (not shown) being acoustically connected to the acoustical pressure pick-up points 202, 203, 204. As already addressed the microphone units applied may be omni directional and/or directional microphones in suitable combinations. Also, microphone modules comprising for example two microphone units and a common back volume are applicable as well.

Figure 3:
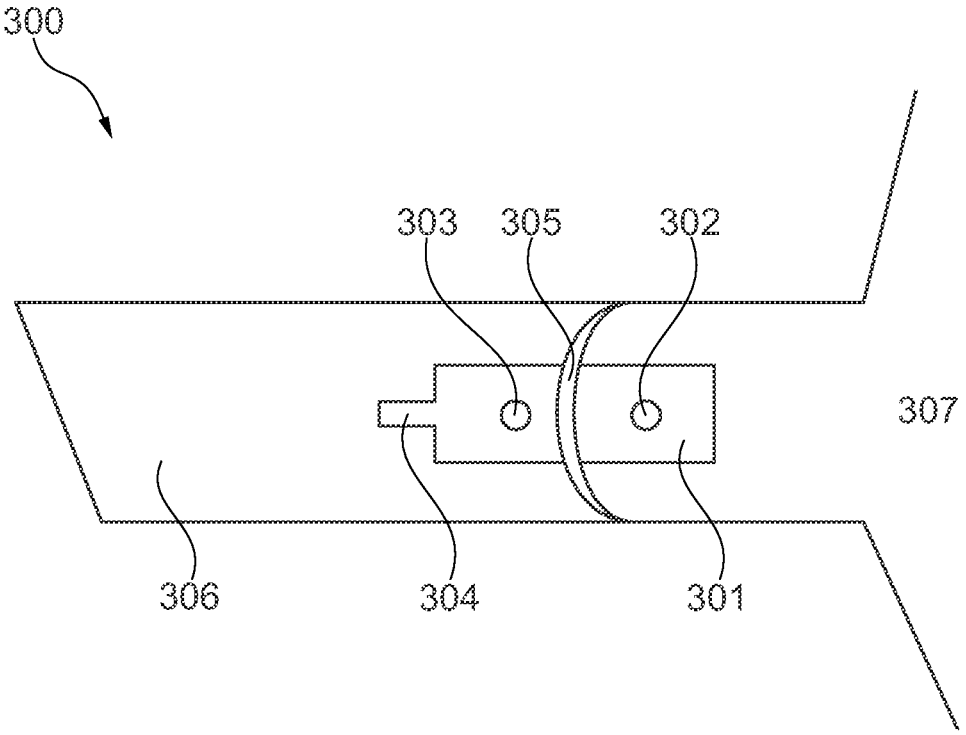
FIG. 3 shows a second embodiment of an acoustical module having two acoustical pressure pick-up points and an acoustical filter by means of a dome positioned therebetween.

FIG. 3 shows a simple embodiment 300 of the present invention. As seen the acoustical module 301 comprises two acoustical pressure pick-up points 302, 303 for receiving incoming sound from the outer ear 307. The acoustical module is positioned in the ear channel 306 with a sound generating receiver 304 facing the eardrum (not shown). A dome shaped acoustical filter 305 is positioned between acoustical pressure pick-up point 302 and 303 so that acoustical sound arriving from the outer ear 307 is attenuated before arriving at pressure pick-up point 303. Thus, the acoustical sound signal reaching pressure pick-up point 303 is attenuated relative to the acoustical sound pressure reaching pressure pick-up point 302.

Figure 4:
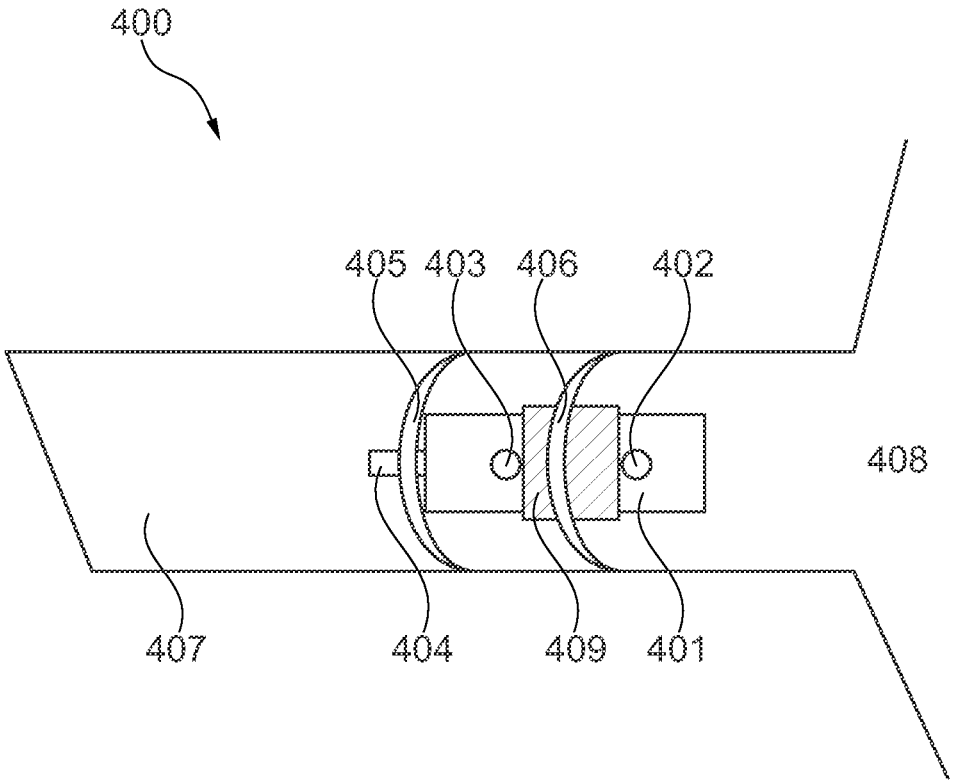
FIG. 4 shows an acoustical module having two acoustical pressure pick-up points and an acoustical dome positioned therebetween, the acoustical filter by means of a dome being secured to a sleeve of a first type.

Referring now to FIG. 4 an embodiment 400 of the present invention is depicted. As seen the acoustical module 401 comprises two acoustical pressure pick-up points 402, 403 for receiving incoming sound from the outer ear 408. The acoustical module is positioned in the ear channel 407 with a sound generating receiver 404 facing the eardrum (not shown). A pair or dome shaped acoustical filters 405, 406 improve the wearing comfort of the acoustical module while being positioned in the ear channel 407. The dome 406 forms an acoustical filter between acoustical pressure pick-up point 402 and 403 so that acoustical sound arriving from the outer ear 408 is attenuated before arriving at pressure pick-up point 403. By applying the above-mentioned signal processing algorithm the influence of self-generated acoustical signals as well as self-generated vibration signals can be attenuated.

The dome 406 is attached to or integrated with the sleeve 409 which is dimensioned to match the outer dimension of the acoustical module 401. The sleeve 409 makes it easier to mount the dome 406 to the acoustical module 401. Preferably, the sleeve 409 is manufactured by a flexible/elastic material so that it may be kept in position relative to the acoustical module 401 by contractive forces. Also, the dome 406 and the sleeve 409 are preferable made as an integrated component, i.e. a one-piece component.

Figure 5:
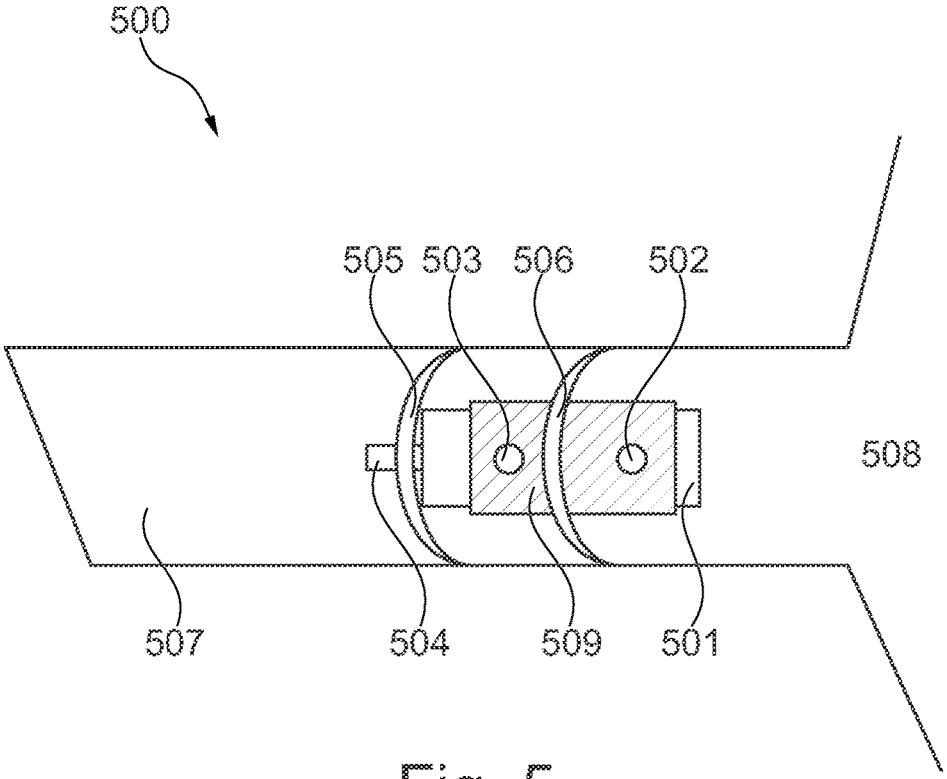
FIG. 5 shows an acoustical module having two acoustical pressure pick-up points and an acoustical filter by means of a dome positioned therebetween, the dome being secured to a sleeve of a second type.

In the embodiment 500 depicted in FIG. 5 the length of the sleeve 509 has been increased so that it now surrounds the two acoustical pressure pick-up points 502, 503 of the acoustical module 501. Similar to the previous figures the acoustical module of FIG. 5 is positioned in an ear channel 507 with a sound generating receiver 504 facing the eardrum (not shown). Again, a pair or dome shaped acoustical filters 505, 506 improve the wearing comfort of the acoustical module while being positioned in the ear channel 507. The dome 506 forms an acoustical filter between acoustical pressure pick-up point 502 and 503 so that acoustical sound arriving from the outer ear 508 is attenuated before arriving at pressure pick-up point 503. As previously stated, by applying the above-mentioned signal processing algorithm the influence of self-generated acoustical signals as well as self-generated vibration signals can be attenuated.

Figure 6:
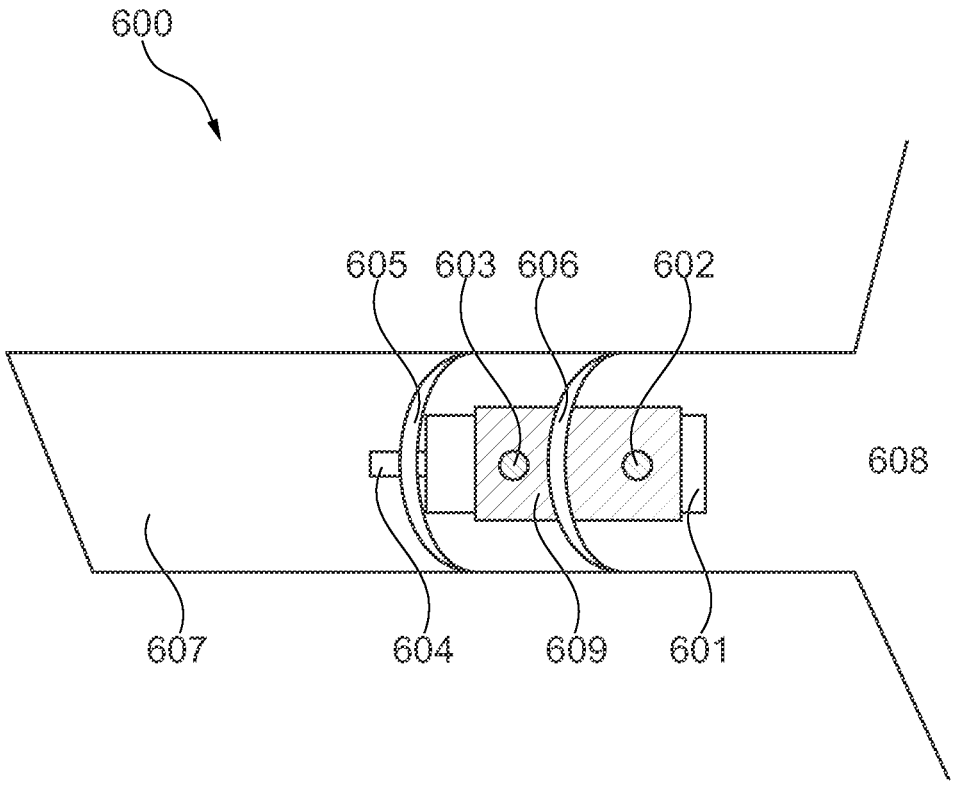
FIG. 6 shows an acoustical module having two protected acoustical pressure pick-up points and an acoustical filter by means of a dome positioned therebetween, the dome being secured to a sleeve of a second type.

In FIG. 6 protection grids have been arranged in front of the two acoustical pressure pick-up points 602, 603. The protection grids may be separate grids or they may form an integral part of the sleeve 609. Otherwise the embodiment 600 of FIG. 6 is similar to that of FIG. 5 thus comprising an acoustical module 601 having domes 605 and 606 attached thereto—the latter via the sleeve 609. A sound generating receiver 604 faces the eardrum of the ear channel 607 which terminates at the outer ear 608.

Figure 7:
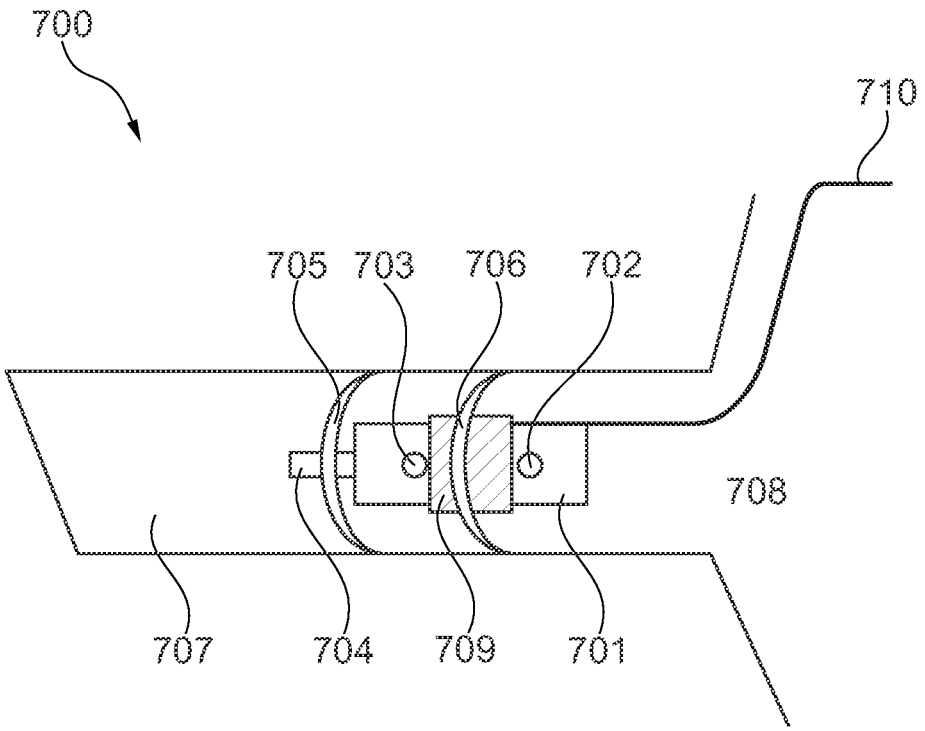
FIG. 7 shows an acoustical module having two acoustical pressure pick-up points, an acoustical filter by means of a dome positioned therebetween, the dome being secured to a sleeve of a first type, and a locking mechanism.

The embodiment 700 shown in FIG. 7 has an integrated sports lock 710. Otherwise it us similar to the embodiment shown in FIG. 4 thus comprising an acoustical module 701 comprises two acoustical pressure pick-up points 702, 703 for receiving incoming sound from the outer ear 708. The acoustical module is positioned in the ear channel 707 with a sound generating receiver 704 facing the eardrum (not shown). The two dome shaped acoustical filters 705, 706 improve the wearing comfort while being positioned in the ear channel 707. The dome 706 forms an acoustical filter between acoustical pressure pick-up point 702 and 703. By applying the above-mentioned signal processing algorithm the influence of self-generated acoustical signals as well as self-generated vibration signals can be attenuated. The implementation of the dome 706/sleeve 709 is disclosed in detail in relation to the embodiment shown in FIG. 4.

In the above embodiment the domes 105, 206, 405, 505, 605 and 705 have been disclosed as acoustical filters. However, this may necessary not be the case in that these domes have the primary purpose of supporting the acoustical module.

The invention claimed is:

1. An acoustical module comprising
- a receiver unit for generating audio sound,
- a plurality of microphone units for receiving acoustical pressure signals,
- a plurality of acoustical pressure pick-up points, each of said acoustical pressure pick-up points being acoustically connected to a microphone unit, and
- a first acoustical filter for attenuating an acoustical pressure signal arriving at a first acoustical pressure pick-up point relative to a second acoustical pressure pick-up point, and
- a second acoustical filter for attenuating an acoustical pressure signal arriving at a third acoustical pressure pick-up point relative to the second acoustical pressure pick-up point.

2. An acoustical module according to claim 1, wherein the first acoustical filter is positioned between the first and the second acoustical pressure pick-up points.

3. An acoustical module according to claim 1, wherein a first microphone unit is acoustically connected to the first acoustical pressure pick-up point, and wherein a second microphone unit is acoustically connected to the second acoustical pressure pick-up point.

4. An acoustical module according to claim 1, wherein the first acoustical filter forms part of a dome shaped structure or being attached to a dome shaped structure.

5. An acoustical module according to claim 4, further comprising one or more additional dome shaped structures or elements for additional support of the fixation of the acoustical module in the ear channel.

6. An acoustical module according to claim 1, wherein the first acoustical filter forms part of an element which is adapted to support fixation of the acoustical module in an ear channel.

7. An acoustical module according to claim 5, further comprising one or more additional dome shaped structures or elements for additional support of the fixation of the acoustical module in the ear channel.

8. An acoustical module according to claim 1, wherein the second acoustical filter is positioned between the second and the third acoustical pressure pick-up points.

9. An acoustical module according to claim 8, wherein the second acoustical filter forms part of a dome shaped structure or is attached to a dome shaped structure.

10. An acoustical module according to claim 9, wherein the dome shaped structure is shaped in a manner so that it supports fixation of the acoustical module in an ear channel.

11. An acoustical module according to claim 1, wherein the plurality of microphone units comprise omni-directional microphone units and/or directional microphone units.

12. An acoustical module according to claim 1, further comprising a sleeve arranged on the exterior of the acoustical module.

13. An acoustical module according to claim 12, wherein the sleeve and the acoustical filter form a one-piece component.

14. An acoustical module according to claim 12, further comprising a protection arrangement for preventing dust or other impurities to enter the plurality of acoustical pressure pick-up points.

15. An acoustical module according to claim 14, wherein the protection arrangement comprises a number of barrier structures being secured to or forming part of the sleeve.

16. A hearing device comprising an acoustical module according to claim 1.

17. An acoustical module according to claim 1, wherein a third microphone unit is acoustically connected to the third acoustical pressure pick-up point.

* * * * *